US005553525A

United States Patent [19]

Mailey et al.

[11] Patent Number: 5,553,525

[45] Date of Patent: Sep. 10, 1996

[54] PUNCH PRESS MACHINE

[75] Inventors: Desmond Mailey; Jose J. Rodriguez; Jerry P. Fregoe; Curtis L. Stevens; Frank M. Dettmers, Sr., all of San Diego; Glenn L. Brown, Escondino; Gary L. Kitzer, Lemon Grove; James G. Miller, Coronado, all of Calif.; Martin J. Hillbrands; Carl F. Strebel, both of Grand Rapids, Mich.; Thomas A. King, Lakeside, Calif.

[73] Assignee: Solar Turbines Incorporated, San Diego, Calif.

[21] Appl. No.: 266,808

[22] Filed: Jun. 28, 1994

[51] Int. Cl.[6] ..... B21D 28/30

[52] U.S. Cl. ..... 83/184; 83/188; 83/452; 83/560

[58] Field of Search ..... 83/184, 188, 451, 83/452, 917, 560, 561, 562, 563; 227/27

[56] References Cited

U.S. PATENT DOCUMENTS 4,354,407 10/1982 Daudi et al. ..... 83/452 X
4,426,899 1/1984 Long et al. ..... 83/188
4,470,330 9/1984 Lindell ..... 83/188 X
4,599,924 7/1986 Klostermann et al. ..... 83/188 X
4,831,910 5/1989 Poulsen ..... 83/917 X
4,854,201 8/1989 Shinozawa et al. ..... 83/188 X
5,169,047 12/1992 Endres et al. ..... 227/27

*Primary Examiner*—Rinaldi I. Rada
*Attorney, Agent, or Firm*—Kenneth A. Rhoads

[57] ABSTRACT

A punch press machine for punching a series of holes in a cylindrical work piece has a main frame, a clamping fixture for holding the work piece, and a punch press frame having a horizontal moving punch and a die for receiving the punch. The clamping fixture is moveable relative to the main frame along a first horizontal axis and the punch press frame is moveable relative to the main frame along a second vertical axis for lowering the punch and die into a punching position with the punch on one side of the work piece and the die on the other side of the work piece.

6 Claims, 4 Drawing Sheets

PUNCH PRESS MACHINE

TECHNICAL FIELD

The present invention relates to a punch press machine for punching holes and the like in a ring shaped work piece. More particularly, this invention relates to a punch press machine having a main frame, a clamping fixture for holding the work piece on the main frame, and a press frame having a punch and a die. The clamping fixture for holding the work piece is both rotatable and moveable along a first axis. The press frame is moveable relative to the main frame along a second axis.

1. Background Art

Punch presses lack the ability to expeditiously position and reposition a hollow cylindrical work piece and to effectively punch a series of circumferentially spaced holes through the work piece. Present punch press machines suffer from limitations with respect to versatility, ease of adjustment, alignment of the punch and die, complexity and cost.

Thus, what is needed is a punch press machine that is capable of quickly and accurately positioning a work piece. The present invention is directed to overcoming one or more of the problems set forth above.

2. Disclosure of the Invention

In one aspect of the invention, a punch press machine is provided for punching holes in a work piece. The punch press machine has a main frame, a clamping fixture for holding the work piece, a press frame having a punch connected to the press frame for piercing the work piece, and a die having a preselected opening of a configuration sufficient for receiving the punch.

The clamping fixture is moveable relative to the main frame along a first axis. The press frame is moveable relative to the main frame along a second axis to a preselected position with the die adjacent the work piece and the punch positioned adjacent the die opening and on an opposed side of the work piece.

The punch is controllably moveable into and through the work piece and into the die opening. Means controllably move the clamping means. Means are provided for controllably moving the punch through the work piece. Means are also provided for controllably moving the press frame.

In another aspect of the invention a punch press machine has a main frame. The main frame has a machine base having a generally horizontal base mounting defining a "x" axis and a column having a generally vertical column mounting defining a "y" axis.

A clamping fixture is provided for holding a work piece. The clamping fixture is slidably supported on the base and adapted for movement along the x axis.

A punch press assembly for punching a hole in a work piece is slidable supported on the column mounting surface and adapted for movement along the y axis. The punch press assembly includes a housing assembly having a fixed die platen for support of a die and a punch platen for support of a punch. Actuation means controllably moves the punch platen relative to the die platen.

In yet another aspect of the invention, a punch press machine is provided for sequentially punching a series of holes through a hollow cylindrical work piece having an inner surface and an outer surface. A moveable work piece clamping fixture is mounted for movement along a horizontal axis. A punch press frame is mounted for movement along a vertical axis. A horizontal moving punch and a fixed die having a preselected opening of a configuration sufficient for receiving the punch.

Means is provided for controllably moving the clamping fixture along the horizontal axis to position the workpiece into a punching position. Means is provided for controllably lowering the punch and die toward the work piece into punching position whereby the punch is disposed on one side of the workpiece and the die is disposed on the other side of the workpiece. Means is also provided for rotatable indexing the workpiece relative to the punch whereby a series of sequentially holes maybe punch through the workpiece.

BEST MODE FOR CARRYING OUT THE INVENTION

Figure 1:
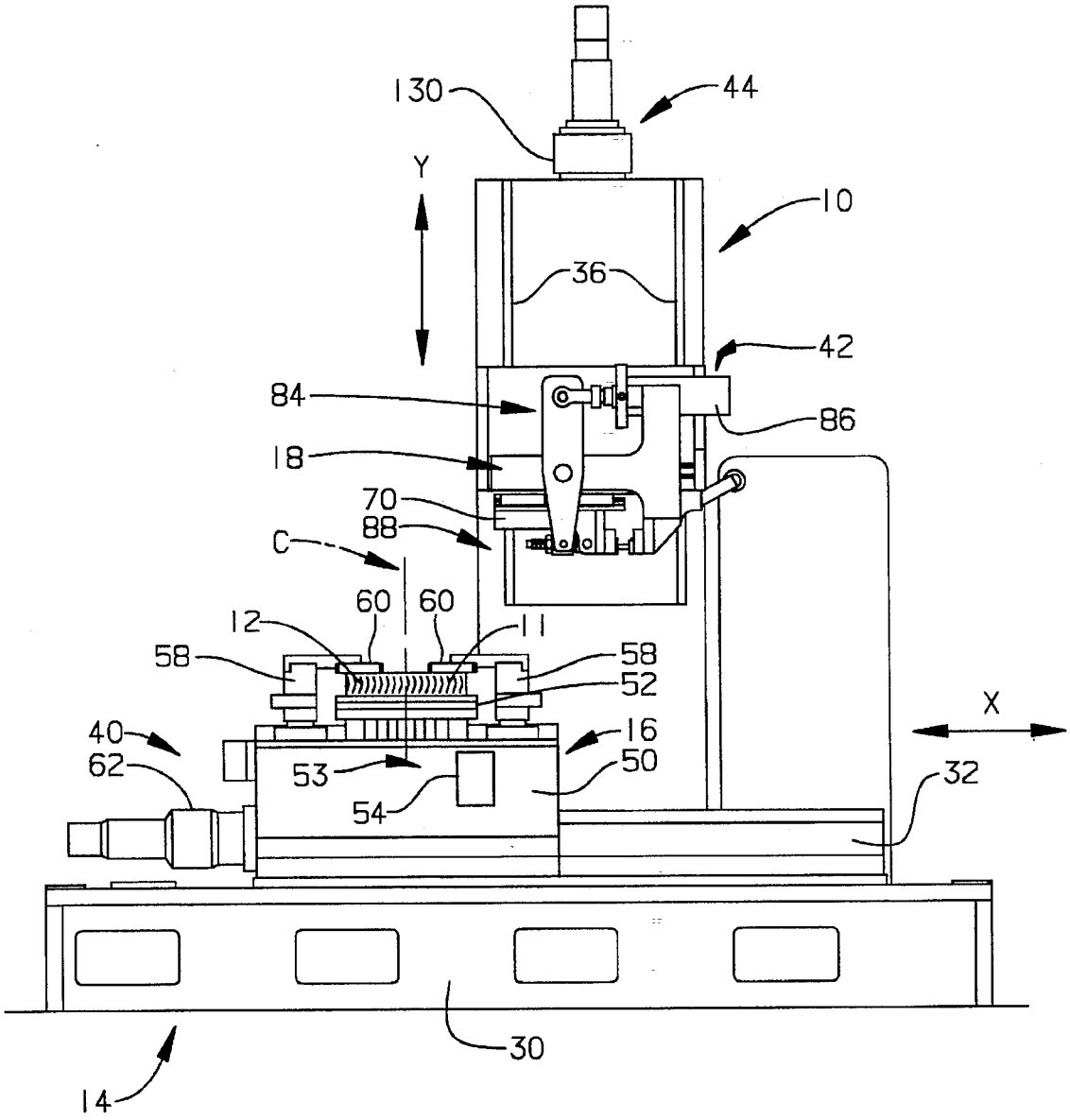
FIG. 1 is a diagrammatic, front elevational view of the punch press machine.
Figure 2:
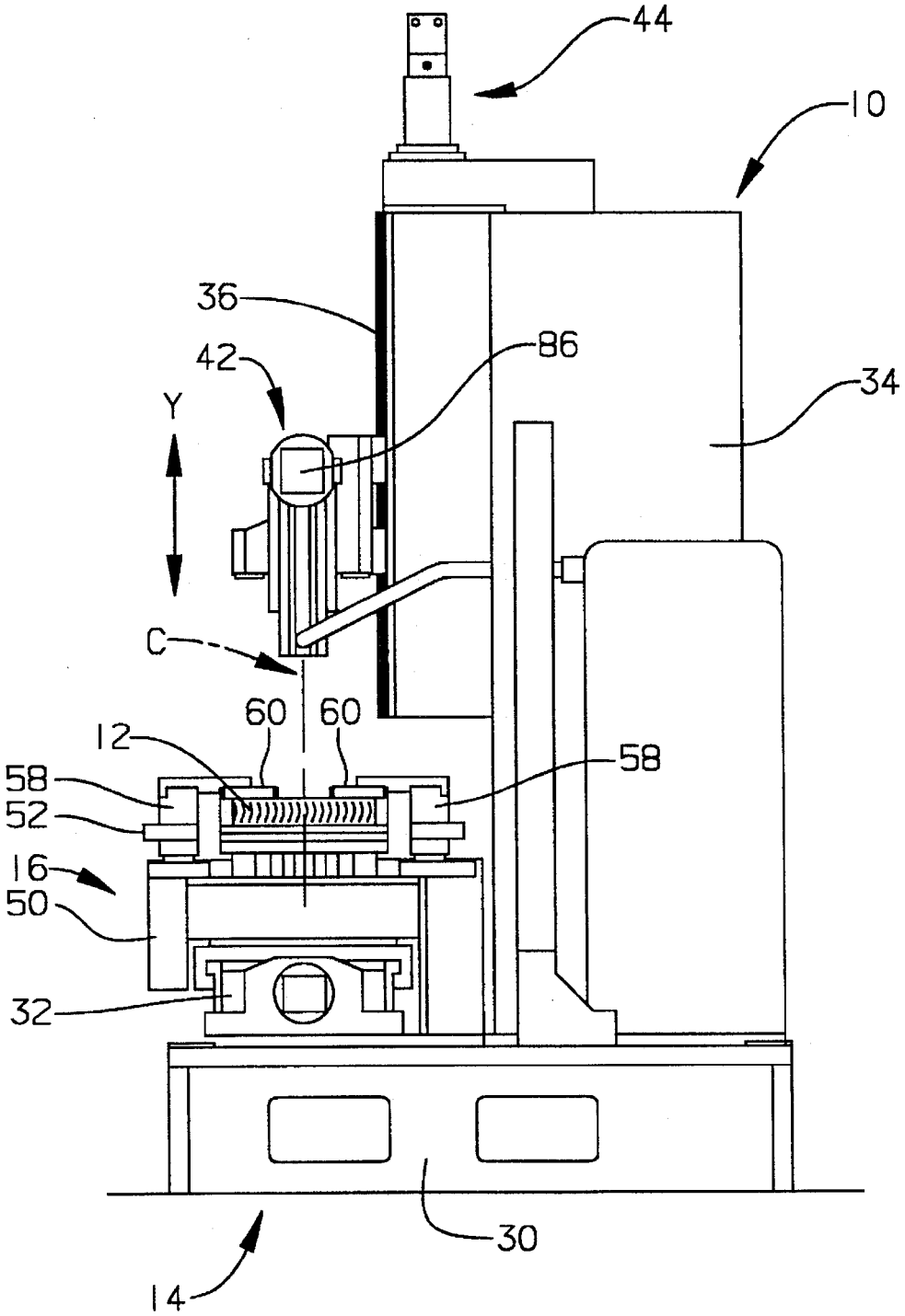
FIG. 2 is a diagrammatic, side elevational view of the punch press machine.
Figure 3:
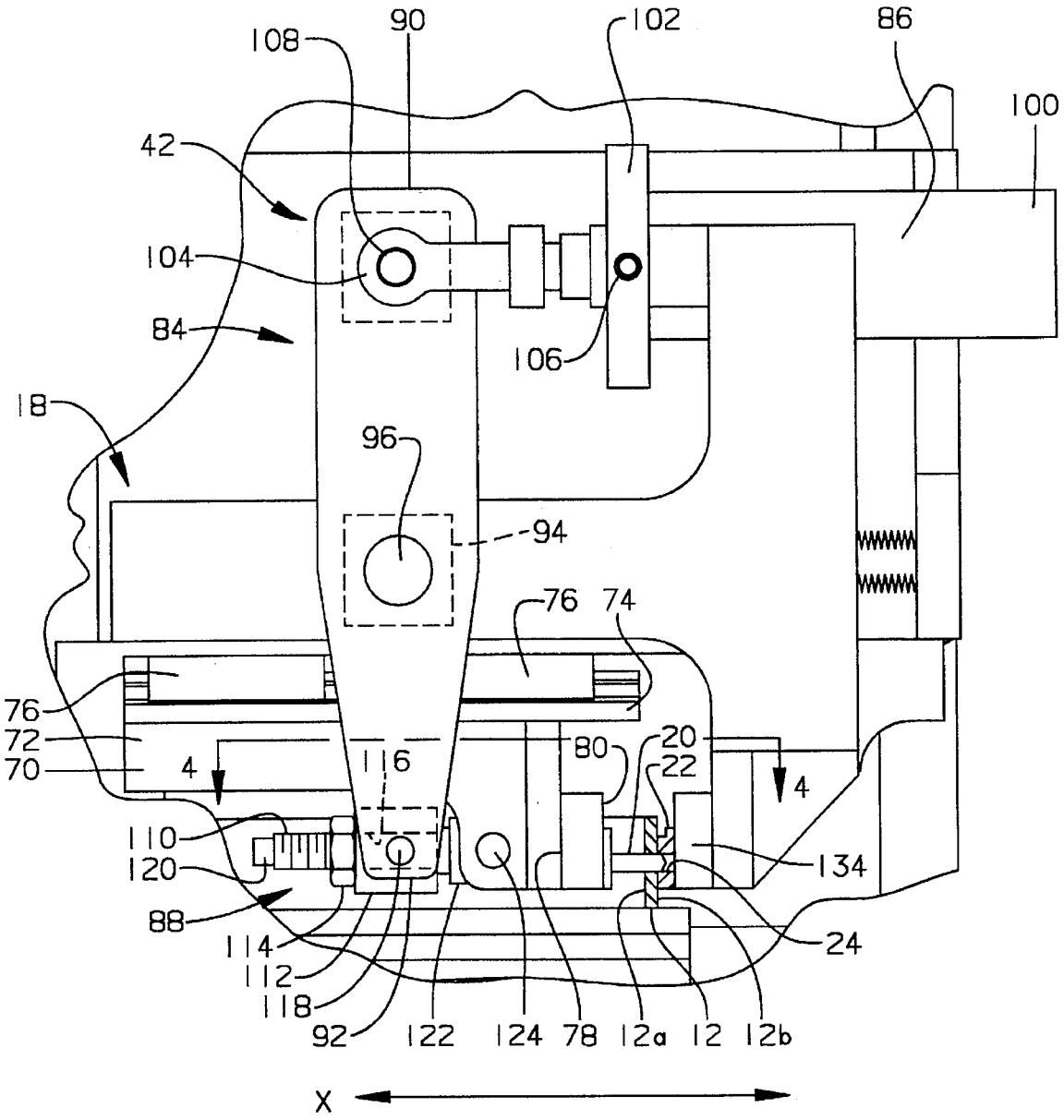
FIG. 3 is an enlarged, fragmentary front elevational view of the punch press frame with attached punch and die.

With reference to the drawings and particularly FIGS. 1, 2, 3, and 4, a punch press machine 10 for sequentially punching a series of holes 11 through a hollow cylindrical work piece or product 12 having an inner surface 12*a* and an outer surface 12*b*. In particular, the punch press machine 10 includes a main frame 14, a moveable work piece clamping fixture 16 for holding the work piece 12, and a punch press frame 18. As best shown in FIG. 3, the press frame 18 has a horizontally moving punch 20 connected to the press frame for punching the holes in the work piece 12, and a die 22 having a preselected opening 24 of a configuration sufficient for receiving the punch 20. The die 22 is fixedly connected to the press frame 18. The punch 20 is controllably moveable through the work piece 12 into the die opening 24 at predetermined spaced locations.

As illustrated, the main frame 14 has a machine base 30 having a generally horizontal base mounting 32 defining a first horizontal x axis and a column 34 having a generally vertical column mounting 36 defining a vertical second y axis. The first x axis is perpendicular to the second y axis.

The punch press machine 10 further includes means 40 for controllably moving the clamping fixture 16 along the horizontal first x axis to position the work piece 12 into a punching position under the punch 20 and die 22, means 42 for controllably moving the punch 20 through the work piece 12, and means 44 for controllably moving the punch press frame 16 along the vertical second y axis lowering the punch 20 and die 22 toward the work piece 12 and into a punching position whereby the punch 20 is disposed on one side of the work piece and the die 22 is disposed on the other side of the work piece.

The clamping fixture 16 for holding the work piece 12, for example a cylindrical stator ring or shroud of a gas turbine engine, is slidably supported on the mounting surface 32 and adapted for movement relative to the main frame 14 along the first horizontal x axis.

The clamping fixture 16 includes a base 50 slidably connected to the main frame 14 and a rotatable table 52 having a vertical central axis of rotation c connected to the clamping base 50. The work piece 12 is positioned on the rotatable table 52 so that the axis c of rotation of the rotatable table lies along an axis of symmetry of the work piece. The central axis of rotation c is perpendicular to the first axis x. Means 53 is provided for rotatably indexing the work piece 12 relative to the punch 12 whereby the series of sequential holes 11 maybe punched through the work piece 12. The means 53 includes a stepping motor 54 connected to the rotatable table 52 to rotate the rotatable table about the axis c and precisely locate the work piece 12 relative to the punch 20 and die 22 during the punching operation. It is to be noted that other devices, such as fluidics motors or the like may be used to index the work piece 12.

The clamping fixture 16 further includes clamping means 58 supported on the base 50. The clamping means 58 includes a plurality of hold downs 59 each having a roller 60 rollingly engageable with the work piece 12 and permit indexing of the work piece 12 by rotation of the table 52 while maintaining clamping engagement with the work piece. The hold downs 58 are selectively moveable relative to the rotatable table 52 to permit removal and installation of the work piece 12. Movement of the hold downs 58 may be achieved manually or by any suitable drive means, such as a screw drive or jack arrangement.

The means 40 for controllably moving the clamping means 16 along the first axis x includes an electrically driven ball screw 62 connected between the clamping base 50 and the main frame 14.

The punch press frame 18 for piercing the work piece 12 is slidably supported on the column mounting surface 36 and adapted for movement relative to the main frame 14 along the second vertical y axis to a predetermined position with the work piece 12 such that the punch 22 is positioned adjacent the inner surface 12*a* and the die 22 is positioned adjacent the outer surface 12*b* of the work piece.

Figure 4:
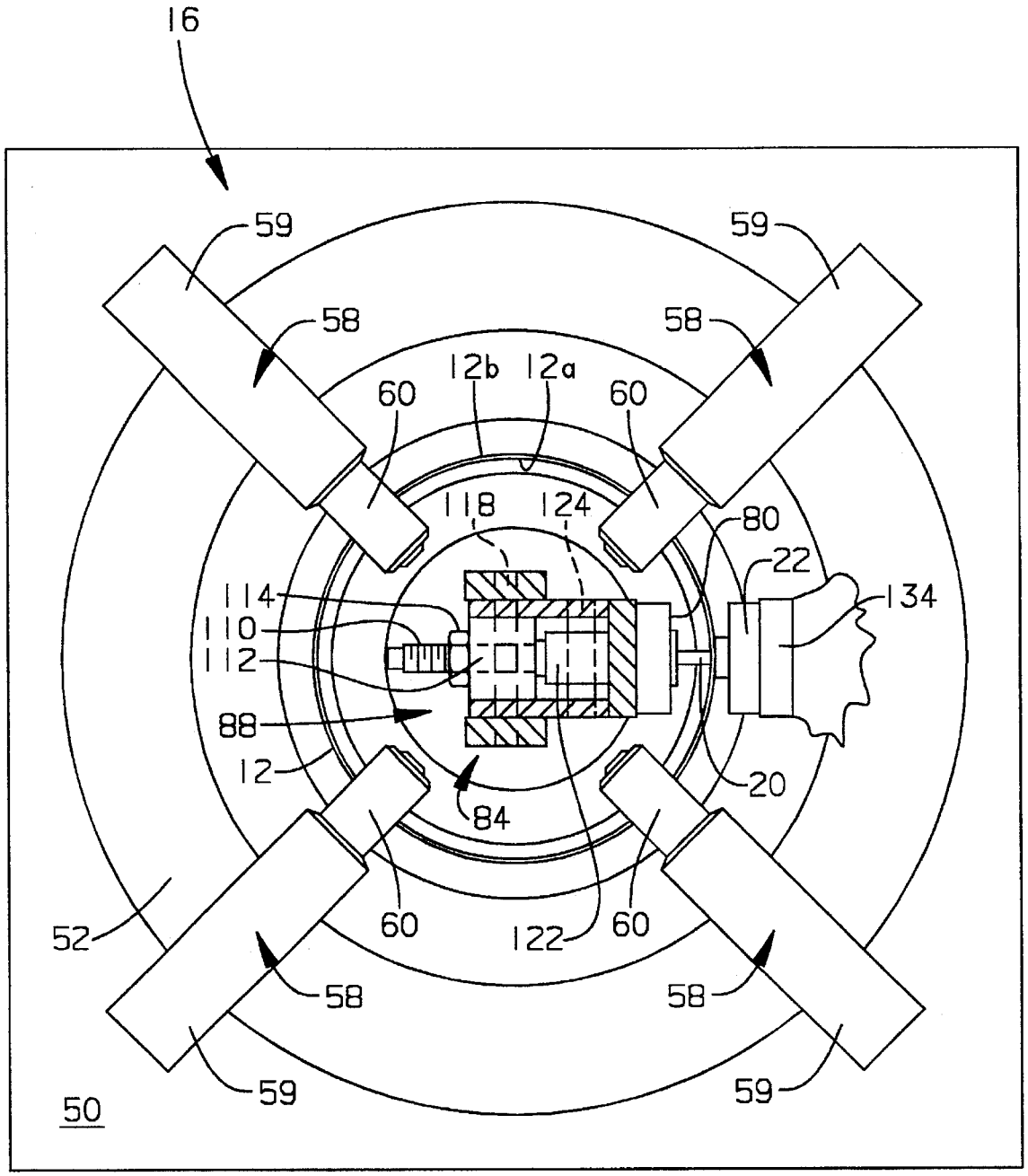
FIG. 4 is a diagrammatic, cross-section view taken along section 4—4 of FIG. 3.

Referring now to FIGS. 1, 2, and 4, the punch 22 connection to the punch frame 18 includes a carriage 70 having first and second carriage end portions 72 and 74. As best shown in FIGS. 3 and 4, a fixed punch platen 78 having a punch platen mounting surface 80 for support of the punch 22 is secured to the second end 74 of the carriage 70. The carriage 70 is connected to the punch press frame 12 by a pair of space linear bearings 76. The carriage 70, punch platen 78 and punch 20 are slidably supported on the punch frame 18 for horizontal movement parallel to the x axis.

As can be seen in FIGS. 1 and 3, the actuation means 42 for controllably moving the punch 20 through the work piece 12 includes an actuation lever 84, a hydraulic actuation cylinder 86, and a link assembly 88. The actuation lever 84 has a first lever end portion 90, a second lever end portion 92, and a center lever portion 94. The center lever portion 94 of the lever 84 is pivotally connected to the punch frame 18 about a lever pivot axis 96.

The actuation cylinder 86 has a first head end portion 100, an intermediate cylinder portion 102, and a second rod end portion 104. The intermediate cylinder portion 102 is connected to the punch press frame 18 about a cylinder pivot axis 106 with the second rod end portion 104 pivotally connected to the first lever end portion 90 of the lever 84 about a first lever pivot axis 108.

The link assembly 88 includes a threaded link member 110, a connector member 112 and a lock nut 114. The connector member 112, defining a threaded bore 116, is pivotally secured to the second lever end portion 92 of the actuation lever 84 about a second lever pivot axis 118. The link member 110 has a first threaded end portion 120 and a second link end portion 122. The first threaded end portion 120 threadably engages with the internal threaded bore 116 of the connector member 112 and the second link end portion 122 is pivotally connected to the carriage 70 about a pivot axis 124.

As best shown in FIGS. 1 and 2 the means 44 for moving the punch frame 18 includes an electrical driven ballscrew 130 carried on the column 34 of the main frame 14 and operatively connected to the punch frame 18.

The punch frame 18 further includes a fixed die platen 134 and the die 20 is connected to the die platen.

Industrial Applicability

With reference to the drawings, the punch press machine 10 is capable of being quickly and accurately adjusted and aligned for punching equally spaced, radially oriented, holes or irregular slots 11, disposed around the periphery of the ring shaped work piece 12 that is clamped to the rotatable table 52.

The work piece 12 is clamped about an axis c of the rotating table 52 by the plurality of hold downs 58. The table 52 is connected to the base 50 and rotated by the means 54. The base 50 is slidably connected to the main frame 14 of the punch press machine 10 and adapted for movement along the generally horizontal first x axis. The clamping base 50 is controllably moved to preselected locations for loading and unloading the work piece 12 from the clamping fixture 16 and for relative positioning with respect to the punch 20 and die 22 by the electrically driven ball screw 62.

The punch press frame 18 for piercing the work piece 12 is slidably supported on the column mounting surface and adapted for movement along the second vertical axis Y. The punch press frame 18 is moveable relative to the column mounting surface 36 by the electrically driven ball screw 130. The punch press framed 18 is raise vertically above the clamping fixture 16 during the loading and unloading of the work piece 12 from the table 52 and controllably lowered to a preselected position with the punch 22 adjacent the inner surface 12*a* of the work piece 12 and the die 22 adjacent the outer surface 12*b*.

The carriage 70 and connected punch 22 are slidably supported on the punch frame 18 for horizontal movement parallel to the x axis. Actuation of the cylinder 86 moves lever 84 which in turn moves link assembly 88 forcing the punch 22 through the work piece 12 and into the die opening 24 of the die 22.

Other aspects, objects, and advantages become apparent from a study of the specification, drawings, and appended claims.

We claim:

1. A punch press machine for punching a hole in a work piece, comprising:

a main frame having a machine base having a generally horizontal base mounting defining an axis x and a column having a generally vertical column mounting defining an axis y and said axis x being perpendicular to said axis y;

clamping means for holding a work product, said clamping means being slidably supported on the base mounting and adapted for movement along the axis x;

a punch press frame being slidably supported on the column mounting and adapted for movement along the axis y to a predetermined position, said punch press frame includes a carriage having a punch connected to said carriage, a die having an opening for receiving the punch, said carriage being slidably supported on the punch press frame for movement parallel to the axis x; and actuation means for controllably moving the punch through the work piece.

2. The punch press machine of claim 1, wherein the clamping means includes a clamping base and a rotating table having central clamping axis c connected to the clamping base, said central axis c being perpendicular to the axis x and a stepping motor for rotating the rotating table.

3. The punch press machine of claim 1, wherein said movement of the punch press frame includes an electrical driven ballscrew connected between the punch press frame and the column mounting.

4. The punch press machine of claim 1, wherein the clamping means includes a clamping base slidably connected to the main frame and moveable along the x axis and a rotatable table having a central clamping axis connected to the clamping base.

5. The punch press machine of claim 1, further including a means for controllably moving the clamping means which includes an electrical driven ballscrew connected between the clamping base and the main frame.

6. The punch press machine of claim 1 wherein said parallel movement of the carriage is horizontal.

* * * * *